United States Patent [19]

Henson et al.

[11] Patent Number: 4,480,677

[45] Date of Patent: Nov. 6, 1984

[54] METHOD FOR PROCESSING AND FABRICATING METALS IN SPACE

[76] Inventors: H. Keith Henson, 1010 E. Speedway, Tucson, Ariz. 85719; K. Eric Drexler, 518 Putnam Ave., #9, Cambridge, Mass. 02139

[21] Appl. No.: 160,224

[22] Filed: Jun. 17, 1980

Related U.S. Application Data

[63] Continuation-in-part of Ser. No. 737,577, Nov. 1, 1976, abandoned.

[51] Int. Cl.[3] ..... B22D 19/04; B22D 23/00

[52] U.S. Cl. ..... 164/46; 164/108

[58] Field of Search ..... 164/46, 45, 9–11, 164/98–100, 108–110, 34–36; 29/418, 423, 424; 228/212; 264/81; 427/250

[56] References Cited

U.S. PATENT DOCUMENTS

| | | | |
|---|---|---|---|
| 1,880,786 | 10/1932 | Carey | 164/109 |
| 1,947,493 | 2/1934 | Rose et al. | 164/46 X |
| 1,953,075 | 4/1934 | Collins | 164/9 X |
| 2,752,662 | 7/1956 | Crooks et al. | 29/424 |
| 3,190,778 | 6/1965 | Dahlberg | 164/46 X |
| 4,009,516 | 3/1977 | Chiang et al. | 29/424 X |
| 4,076,860 | 2/1978 | Kuroda | 427/250 X |
| 4,268,946 | 5/1981 | Eisenberg | 29/424 |

*Primary Examiner*—Kuang Y. Lin

*Attorney, Agent, or Firm*—Dula, Shields & Egbert

[57] ABSTRACT

The present invention relates to method and apparatus for fabricating materials and objects, and processing and refining metals in space by means of available sunlight energy.

5 Claims, 9 Drawing Figures

METHOD FOR PROCESSING AND FABRICATING METALS IN SPACE

REFERENCE TO PRIOR APPLICATION

This is a continuation in part of application Ser. No. 737,577, filed Nov. 1, 1976, now abandoned.

BACKGROUND OF THE INVENTION

Within the past year two initially unrelated studies of the uses of outer space have merged. The first, represented by U.S. Pat. No. 3,781,647, involves the collection and transmission to the Earth of solar energy from space. This as an energy program seems to be of marginal economic return (using current or currently projected technology) due to high lift cost if the components of the solar power satellites are shipped up from the Earth. The second began as an academic study of the building of facilities in high Earth orbit which had no clear economic justification. A synthesis of the two concepts was published in *Science,* Dec. 5, 1976. (Space Colonies and Energy Supply to the Earth: G. K. O'-Neill, Vol. 190, page 943. )

The key points are:

a. obtaining materials from the surface of the moon, or other extraterrestrial sources.

b. refining these materials in an industrial plant in a seldom eclipsed high orbit using solar energy.

c. using the materials thus obtained to build solar satellite power plants and additional industrial plant and living spaces.

(See also "Future Space Programs 1975", Hearings before the Subcommittee on Space Science and Applications of the Committee on Science and Technology, U.S. House of Representatives, pages 111–188 and "Solar Power from Satellites", Hearings before the Subcommittee an Areospace Technology and National Needs of the Committee on Aeronautical and Space Sciences, U.S. Senate, pages 2–155).

The establishment of industrial facilities in outer space will place unusual requirements upon the apparatus and methods used to process and fabricate materials. Desirable features of apparatus and methods for use in outer space include:

a. high ratio of output rate to apparatus mass;

b. low input of materials from earth per unit of output;

c. capability of operating in, and if possible making use of the space environment of vacuum, zero gravity, and solar flux.

Most metal forming apparatus: for example, rolling mills, punch presses and milling machines, and most metal forming methods, of which stamping, extruding, and machining are examples, are not very productive in terms of the mass of product produced in relation to the equipment mass per unit time. These apparatus and methods tend to require supplies such as dies and cutters which would have to be imported from Earth. They also do not make use of the unique space environment.

SUMMARY OF THE INVENTION

The present invention comprises apparatus and methods whereby materials may be processed and formed in space utilizing the special conditions of space to great advantage. More specifically, methods and apparatus are presented which vaporize substances, especially metals, and deposit the resultant vapor in useful shapes on a variety of forms. The processing steps required are:

a. heat a material (not necessarily a metal) to form a vapor;

b. direct the vapor, and c. deposit the material on a form.

To provide the energy required for this process, sunlight is concentrated by a mirror, directed through an aperture, converted to heat by absorption, and the heat conducted to a cavity where metals such as steel or aluminum, are vaporized. The metal is fed into the cavity in the form of a rod. The resultant metal vapors are expanded through a nozzle and directed to a temperature controlled inflated form which may be rotated in the path of the metal vapor beam.

This fabrication method seems particularly well suited for forming seamless pressure vessles on inflated forms, or flat surfaces on endless belts, but is not limited to such shapes and forms. Objects with complex internal structure may be formed provided the surfaces are locally flat or have smooth curves. The metallurgy of vapor deposited metals in particular is well understood and a large number of patents, see for example Cole, U.S. Pat. No. 3,690,333, have been obtained in this field for the use of vapor deposition for coating substrates.

DETAILED DESCRIPTION OF THE INVENTION

Figure 1:
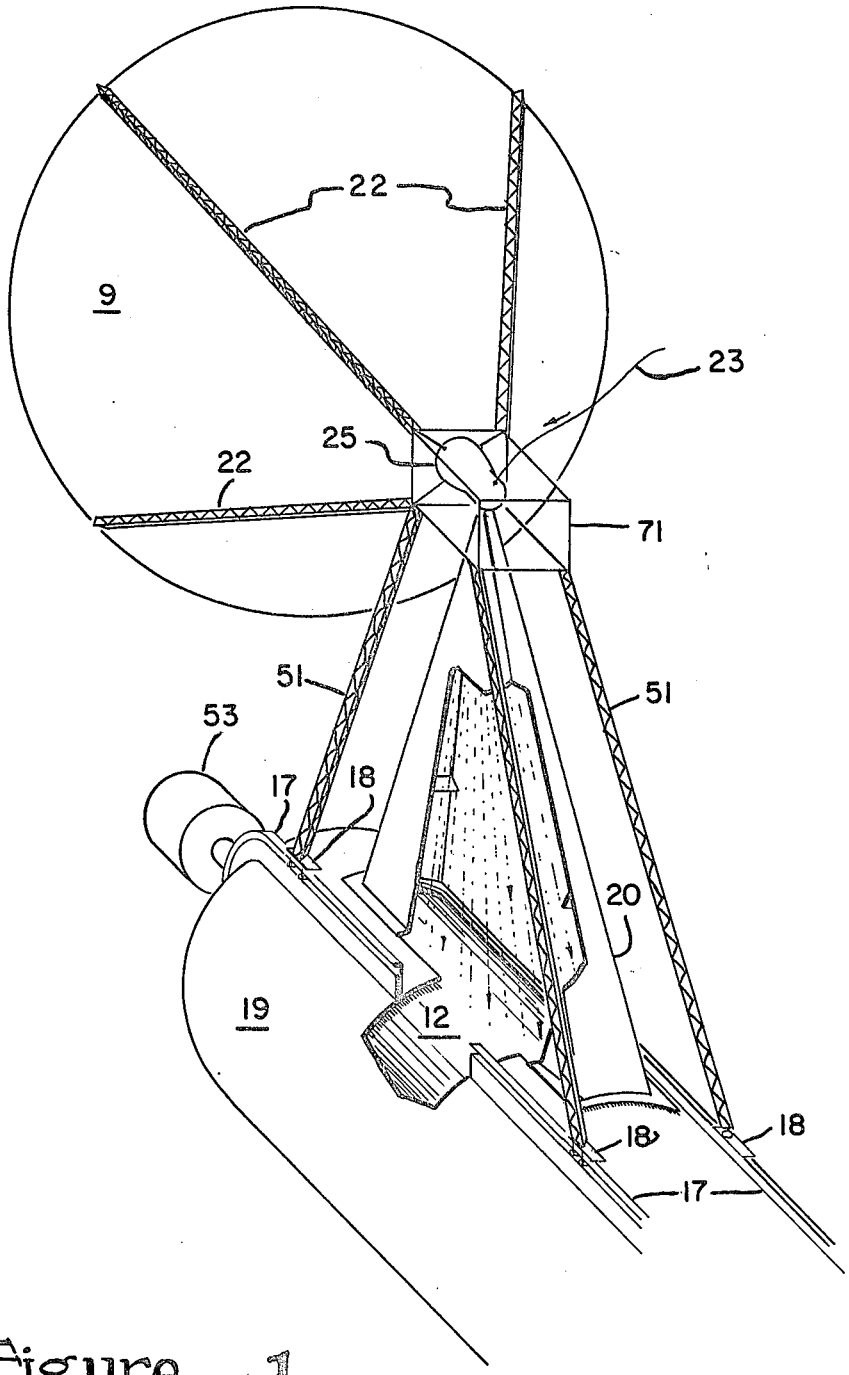
FIG. 1 is a perspective view of the subject invention.

A method for providing solar energy process heat is a part of the preferred embodiment for a forming method particularly adapted to metals having adequate vapor pressure when heated to about 2500 degrees K. Steel and aluminum are examples of metals with adequate vapor pressure at this temperature. For steel or aluminum, a novel two cavity solar furnace/evaporator for obtaining high temperature process heat from solar energy concentrated by a mirror without substantial evaporation of the heated structural components or damage to other parts of the structure, in particular the mirror, by vapor deposits from the hot structural components or the metal being vaporized is described.

The wall material of the cavity containing the metal vapor must be chemically nonreactive with the metal vapor at the operating temperature. Likewise the means used to restrain the vaporizing metals must be chemically nonreactive with the metal vapor and liquid. Metals heated to the vaporizing point, especially aluminum are known to be extremely corrosive. Many patents have been obtained on improvements in preventing destruction of coating apparatus by liquid metal corrosion. (For example, Gallet, U.S. Pat. No. 3,541,301).

Furthermore, there are only a few substances solid at the temperature (circa 2600 deg K) required for efficient operation of a steel or aluminum vaporization apparatus. The refractory metals, tungsten and molybdenum, certain refractory compounds, and carbon in the form of graphite are among the suitable wall candidates for the cavity interiors. (Boron nitride is also satisfactory for the use). However, graphite which is chemically nonreactive with high temperature steel and aluminum vapors (although it reacts with these metals in the liquid state) and which is solid above the temperatures required, sublimes at a substantial rate at 2600 deg K in a vacuum.

For long furnace life the evaporation rate of furnace structural components (primarily the heat absorbing diaphragm between cavities in the furnace) must be kept low and that which unavoidably does evaporate must be kept away from the optical path elements (windows and mirrors).

An inert gas is introduced into the first cavity formed by the window, wall structure and diaphragm. This inert gas, of which argon is a suitable example, at low pressure will retard the evaporation of hot structural components but must be restrained from loss into space by such means as a transparent envelope (a window dome) which must be kept clean of evaporated structural material in order to admit light without excessive losses. A slow flow of inert gas is introduced to sweep evaporated structural material away from the window. The gas flow stagnates proximate the diaphragm. The gas may be removed, cleaned, cooled, and reintroduced by external equipment. The gas may also contain a scavenger element of which hydrogen is an example for use with graphite, and iodine is an example for use with tungsten. The function of a scavenger element is to combine with evaporated structural material and redeposit the structural material by disassociating on the surface from whence it came. Such cycles are widely used in high intensity incandescent lamps.

The gas serves another function, that of balancing the metal vapor pressure on the other side of the diaphragm between the two cavities. The diaphragm is the hottest part of the structure, and though the metal vapor pressure is not large, (on the order of 10 torr) structural creep will be a problem unless the inert gas/metal vapor pressures are substantially balanced. Pressure control for this purpose is incorporated into the gas cleaning and circulating system.

Insulation is required to reduce the loss of heat from the walls of the furnace. Two types of insulation may be used, carbon felt or carbon black near the wall, and radiation shields (spaced sheets of metal) further away. The mass of the insulation is optimized so that the mass of the mirror and the furnace, including insulation is at a minimum (poor insulation can be compensated for by increasing the solar flux input, but not always economically.)

The high intensity light entering through the window and the high temperature which results from losses and radiation from the cavity requires window materials with the qualities of transparency and strength at high temperature. Quartz and sapphire are suitable materials, with sapphire preferred due to its lower light losses and higher strength at high temperatures.

Means are provided to introduce metal into the second metal vapor filled cavity and to allow the vapor to exit in a controlled manner. Metal may be introduced as a liquid or a solid, although liquid metal may cause corrosion problems. Metal in the form of a rod passing through a number of baffles is most convenient as vapor which condenses on the rod will be carried back into the cavity. The rod or rods of metal entering the chamber will merge into a mass of liquid metal at the vaporizing temperature existing within the cavity. This mass must be restrained from touching the walls and its surface area must be large to improve heat transfer and reduce mechanical disturbances due to over rapid boiling of the metal mass at any one point. Surface tension, adhesion to cooled tabs or the feed rods, and electromagnetic fields may be used singly or in combination to restrain and shape the mass of molten metal. The forces required for this restraint are quite small as only minor gas dynamic forces act to displace the molten metal in the absence of gravitational forces. One or more orifices in the shape of a slot nozzle is proviced for the vapors to escape in a directed manner.

Such nozzles have low thermal radiation losses, and relatively low dispersion of metal vapor beam especially away from the plane perpendicular to the slot axis. Vapor leaving the nozzle in directions not desired an material which fails to deposit on the metal vapor collecting form is collected on shields and hoods and recycled. The shields and hoods may serve as part of the temperature control means by serving as thermal radiation shields.

For forming aluminum, active temperature control, i.e., external cooling methods, will be required. Temperature control is essential as the microstructure of vapor deposited metals and hence their bulk mechanical properties such as yield strength and elongation at rupture are controlled by controlling the temperature at which the metal is deposited. In the steady state, with constant metal feed, no liquid metal removal from the metal vapor furnace, and a constant amount of liquid metal in the furnace, the composition of the exiting vapor must be the same as the input rod (conservation of mass). Thus alloys may be deposited of the same composition as the input feed rod. The composition of the liquid metal in the furnace under these conditions will be enriched with the less volatile elements. Alloys may also be formed by simultaneously deposition of alloying elements from another vapor source. Metal deposits of unique microstructure may be made by sequential deposition from different sources. Operation of the vaporizer in non-steady state conditions by continuous removal of part of the molten mass allows the vaporizer to be used for refining, i.e., separation by fractional distillation in accordance with vaporization temperature, by vacuum distillation as well as for fabrication of materials. The removed part may be subjected to other refining methods effective in zero gravity such as slow solidification and mechanical separation of the crystal matrix or crystal/liquid mix.

In addition to depositing simple layers of metal or fabricating closed surfaces like spheres, complex internal structures may be attached to deposited surface layers. This process depends on clean metal surfaces of similar or identical compositions making up part of the substrate upon which the layer is deposited. The remainder of the substrate surface would be removable after the joining surface was deposited.

More specifically, referring to the drawings, FIGS., 1, 2, and 3, structural members 22 connect housing 71 containing solar furnace/evaporator 25 to track drive means 18. The mirror 9 and the structural members 22 and 51 are described by Gregory and Woodcock in "Derivation of a Total Satellite Energy System", AIAA paper 75-640, Apr. 24, 1975. Track drive means 18 travels within track pair 17 proximate inflated form 12. Inflated form 12, constructed on thin plastic film, is rotated by form drive means interiorly to block 53. Block 53 additionally contains means to control temperature and gas pressure within form 12 (see FIG. 6). The inflated form 12 is surrounded by thermal reflective radiation shield 19, such as polished sheet metal, except for the open area between tracks 17. Between this open area and the solar furnace/evaporator 25 are metal vapor rebound control shields 21 and vapor control hood 20. Within hood 20 are vapor direction control shields 24.

Figure 4:
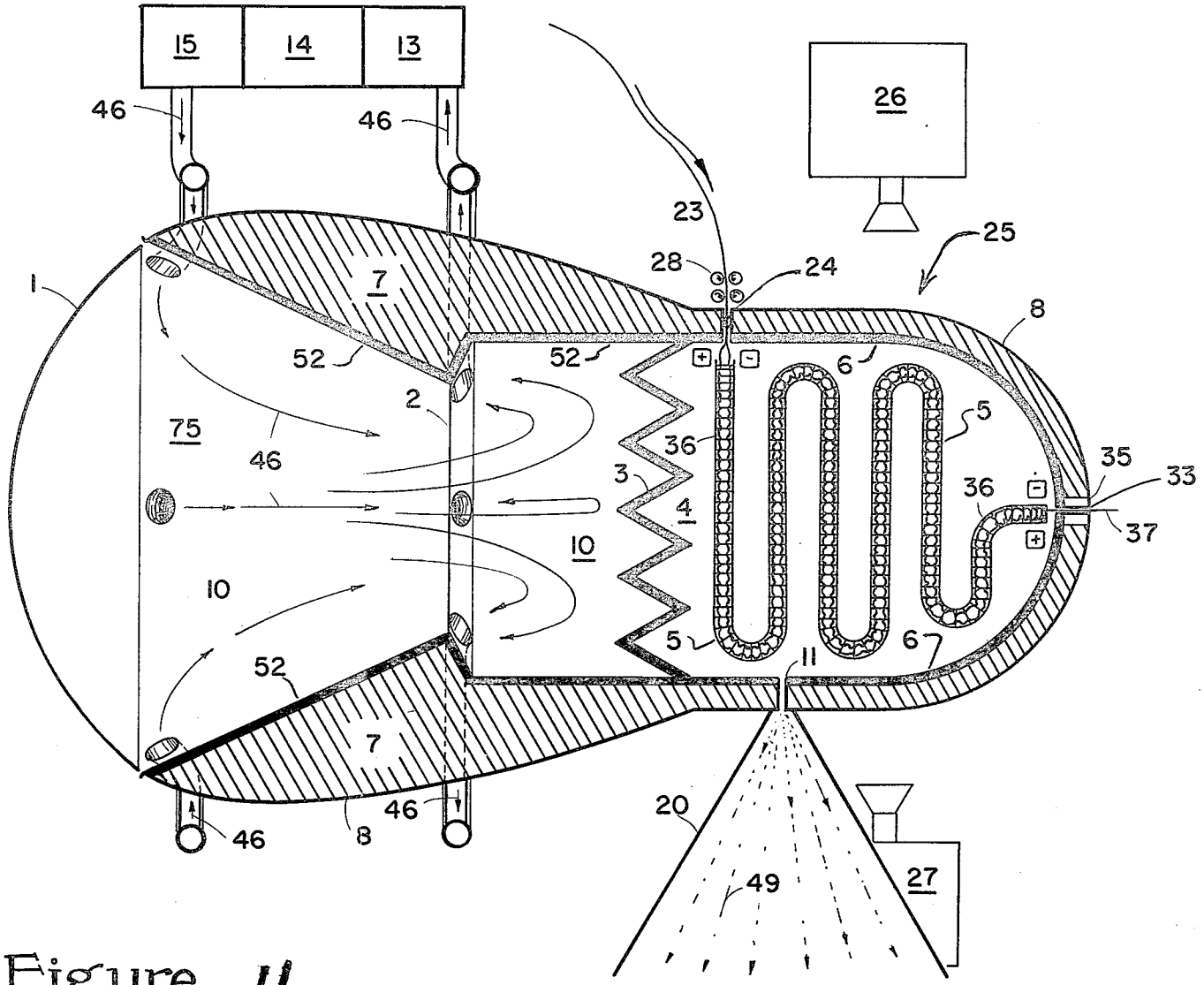
FIG. 4 is a cross-sectional view of the solar furnace/evaporator.

Referring now to FIG. 4, a detailed cross-sectional view of the solar furnace/evaporator, a window dome 1 constructed of preferably sapphire encloses graphite 52 lined plenum 75 containing an inert gas such as argon. The inert gas circulates through gas cooler 13, cleaner 14 and pressure control means 15 as shown by arrows 46. Gas cooler 13 comprises a thermal radiator exposed to space which is well known in the field. Cleaner 14 comprises standard electrostatic filter means and pressure control means 15 comprises pressure sensors, gas containers and pumps arranged to maintain a later specified pressure. Inside optical aperture 2 is gas filled plenum 10, lined cylindrically with graphite 52. A diaphragm 3, also made of graphite, separates gas filled plenum 10 from metal vapor filled plenum 4. Cavity 4 is lined with a vapor barrier wall 6 of graphite. This wall 6 is penetrated by feed rod 23, slot nozzle 11, and if desired, metal removing orifice 33. Within cavity 4 is molten metal mass 5 held interiorly to metal restraining inductor coil 36 by electromagnetic forces.

Surrounding cavities 4 and 10 is insulation 7 consisting of carbon powder and carbon felt proximate the graphite liners 52 and 6. Enclosing the insulation 7 is pressure vessel metal wall 8. Outside of wall 8 are X-ray source 26 and X-ray detector 27 utilized to monitor interior conditions. Also outside of wall 8 is feed rod drive means 28 shown with metal feed rod 23.

Referring now to FIG. 4, operation of the invention is as follows: Sunlight reflected from the mirror is focused through window dome 1, through plenum 75 inside the window containing the inert gas at a slight pressure, and through an aperture 2 into cavity 10 where it is forcused onto diaphragm 3. Here the sunlight is absorbed and converted to thermal energy. The diaphragm 3 separates the inert gas from metal vapor filled cavity 4. Within cavity 4 is a restrained mass of molten metal 5. The restraint means, shown in detail in the left hand side of FIG. 4, consists of the utilization of the combination of surface tension and electromagnetic repulsion (coil 36). A vapor containing graphite wall 6 surrounds the metal vapor cavity 4 and in turn is surrounded by thermal insulation 7 and pressure vessel 8.

Gas conditioning apparatus 13, 14, and 15 consisting of coolers, filters, pumps, and gas holders is provided to introduce gas into the plenum 75 inside of the windows, to control the gas pressure, and to remove the gas for cleaning and reintroduction. The purpose of the gas is to balance the metal vapor pressure on the diaphragm 3, retard evaporation of diaphragm 3, and sweep evaporation products away from the window 1.

The preferred lining for cavities 10 and 4 is graphite. Insulation 7, consisting of carbon black and carbon felt, and radiation shield pressure vessel 8 surrounds the cavities and retards the loss of thermal energy. The preferred window material is sapphire which has excellent optical properties and mechanical strength at high temperatures. Pressure sensing and pressure control are incorporated in the gas flow control system 15 to minimize the pressure differential between the gas filled cavity 10 and the metal vapor filled cavity 4. This reduces the force on the hot diaphragm 3 and retards structural creep. The combination of flowing gas and window protects the mirror from contamination by evaporated diaphragm material.

Feed rod 23 provides the metal, which may be an alloy. The feed rod 23 passes through a series of baffles 24 comprising a series of sized orifices which allow the rod to enter, but keep the metal vapor from leaving cavity 4. Feed rod control is maintained by sensing the amount of liquid metal inside metal vapor filled cavity 4 through X-ray source 26 and X-ray image detector 27 and then adding rod to the liquid metal mass 5 by operating feed rod drive means 28 to make up for that escaping as vapor.

Figure 2:
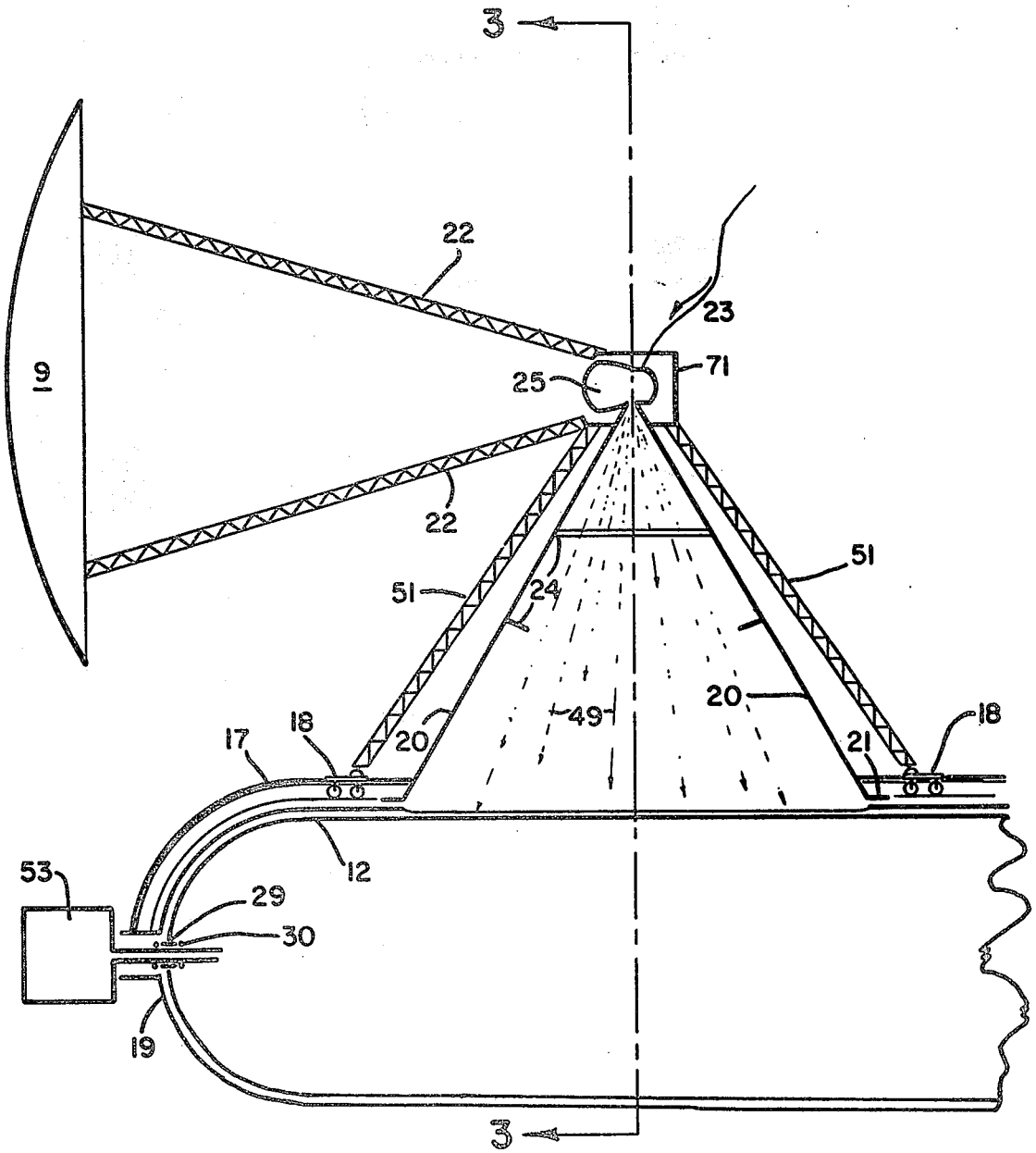
FIG. 2 is a cross-sectional side view of the subject invention.

A slot nozzle 11 provides means for the vapor to escape in a controlled manner. The slot nozzle 11 forms a fan shaped beam of metal vapor 49 which spreads perpendicular to the slot axis. A slot nozzle has low radiation losses compared to the De Laval nozzle as discussed below. The vapor crosses the space between the nozzle 11 and the inflated form 12 and deposits on the form (FIG. 2). An inflated form is particularly convenient if the object being fabricated is cylindrical or spherical in shape. The metal vapor source is moved relative to the form by means of tracks 17 and drive wheels 18.

Figure 6:
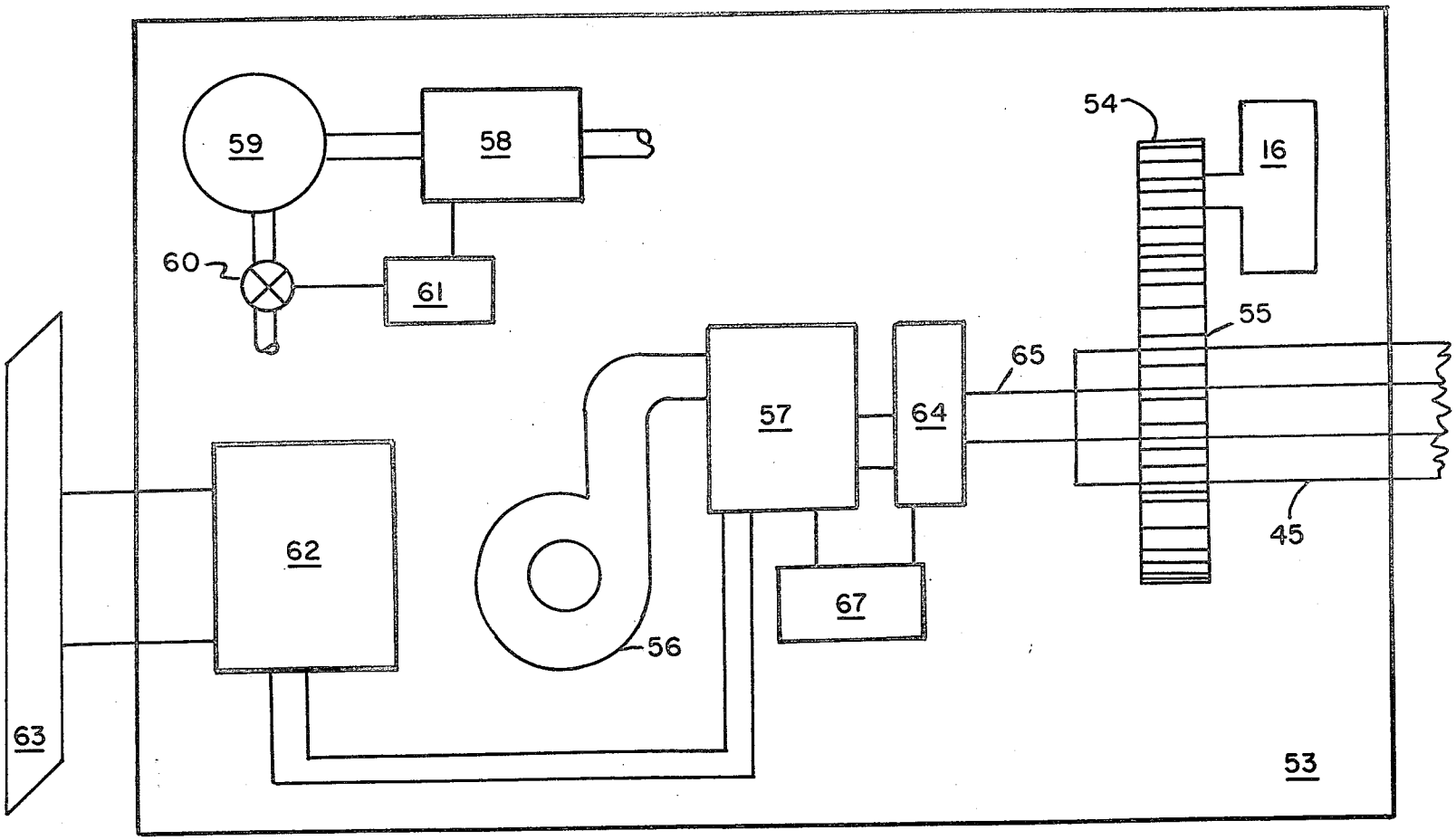
FIG. 6 is a schematic block diagram of enclosure 53 showing means to control temperature and gas pressure within the form for receiving vaporized material.

Referring to FIG. 6, form drive motor 16 through gears 54 and 54 causes hollow shaft 45 to revolve within form bearings 29 and form gas seals 30 (FIG. 2). Shaft 45 carries with it form 12. The remaining equipment within enclosure 53 functions to maintain constant temperature and gas pressure within form 12 which communicates with enclosure 53 by hollow shaft 45. Pressure differences from desired form inflation pressure are sensed by pressure sensor 61 which operates pump 58 if the pressure is higher than desired, or valve 60 if lower than desired. Blower 56 forces form inflation gas through heat exchanger 57 (connected to refrigeration apparatus 62), electric heater 64, and pipe 65 passing through hollow shaft 45 into form 12. Temperature sensor/controller 67 operates heater 64 if the temperature is lower than desired or heat exchanger 57 if higher. Refrigeration apparatus 62 connects with heat exchanger 57 and external radiator 63 to remove heat as necessary. Gas accumulator 59 serves to stabilize gas pressure.

Form drive means 16 rotates the form relative to the vapor source to obtain a uniform thickness of deposited metal. By controlling the temperature of the inflated form 12, the temperature at which the metal vapor is deposited is similarly controlled. In addition, thermal radiation shields 19 surround the form and provide additional control over the deposition temperature. Temperature control is important, as it influences the microstructure of the deposited material, and therefore its bulk properties such as yield strength and elongation at rupture. Vapor control hoods 20 and vapor control shields 21 catch vapor which leaves the nozzle 11 in undesired directions and vapor which rebounds from the form. The hood may serve as part of the radiation shield, and the radiation shields may also capture stray vapor. Metal reclaimed from the hood and shields is returned to rod fabrication.

Figure 5:
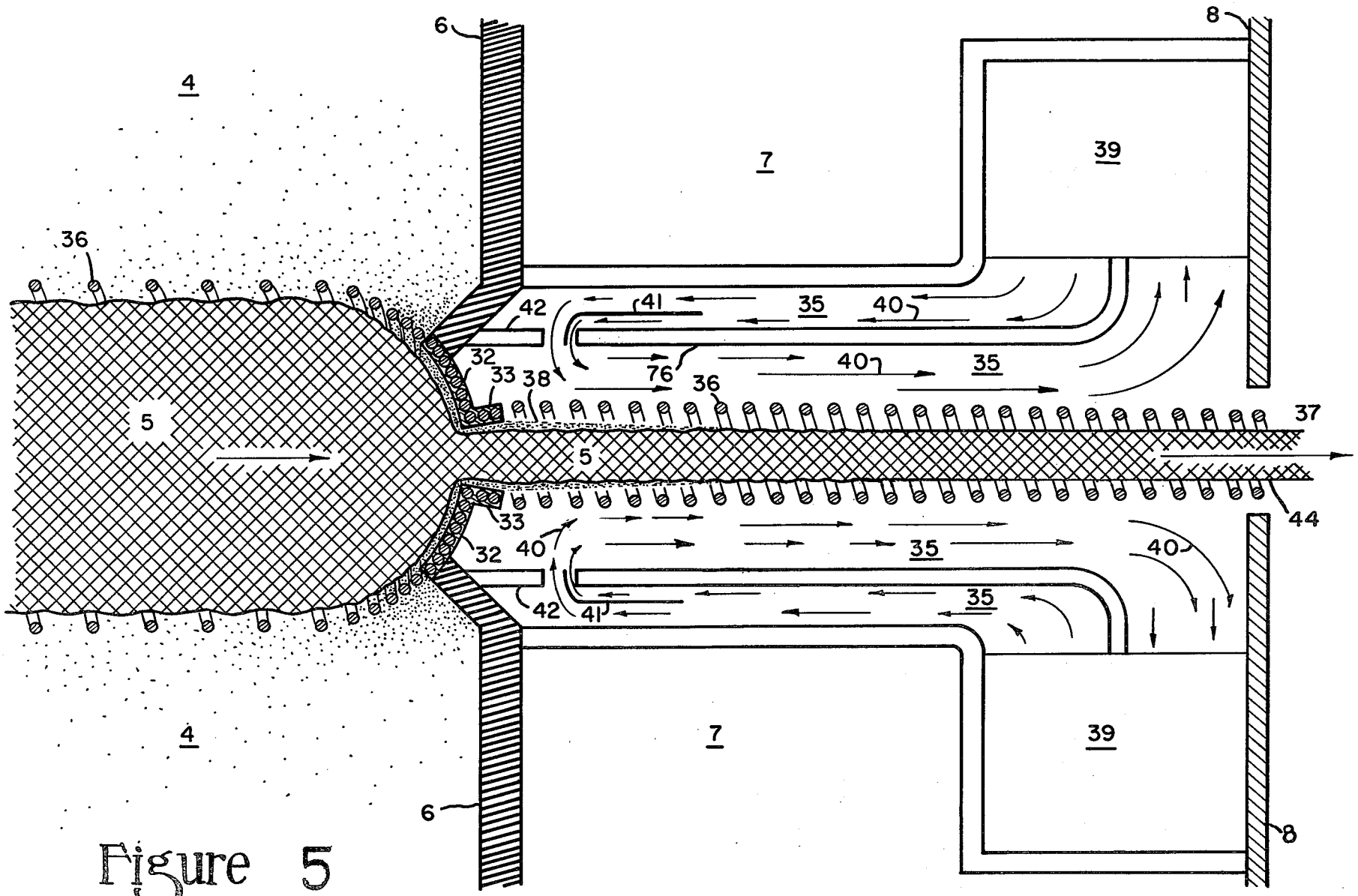
FIG. 5 is an enlarged view of the alternate embodiment metal removing apparatus.

With reference to FIG. 5, for liquid metal removal, i.e., operating the furnace to refine metals as well as fabricating metals, an inductor-retained molten metal mass 5 is brought into close proximity to inductor containing curved plate 32 with a hole extending into an inductor containing sleeve 33. A pressure differential between the metal vapor filled cavity 4 and an inert gas filled chamber 35 beyond the sleeve forces the molten mass to extend through the sleeve into the inert gas filled chamber 35. Contact between the molten mass and solid parts is prevented by electromagnetic repulsion from inductors 36. The molten rod extruded into the chamber 35 is accompanied by a sheath of metal vapor 38 that passes through the inductively maintained clearance between the sleeve 33 and the molten mass due to the aforementioned pressure differential. The inert gas is circulated in accordance with the arrows 40 on the diagram by apparatus 39 which also cools and cleans the gas. The gas flowing between the chamber wall 43 and the partition 41 is heated by electric heater 42, then surrounds the molten rod and flows with it at substantially the same velocity. This hot gas prevents rapid cooling of the metal vapor sheath 38 and the resultant condensation into fine suspended particles. As the molten rod moves away from the sleeve, it cools by radiation to a radiation heat sink 76 maintained at a low temperature, permitting condensation of the metal vapor sheath on the molten rod, shown by the sheath's disappearance as it moves to the right. As the rod continues to the right it cools to the solidification point and begins to freeze to an easily handled solid rod. Initial freezing point 44 is indicated.

ALTERNATE EMBODIMENT

The shape of the nozzle orifice 11 should be designed for small angular dispersion and low heat loss. The convergent-divergent (De Laval type) nozzle has low angular dispersion, but very large heat loss as the divergent section of the nozzle must be kept at nearly the interior temperature of the furnace. At this temperature radiation losses reach megawatts per square meter. A simple circular orifice has much lower heat loss, but suffers from poor control of the directionality of the vapor. For some applications, such as aluminizing the surface of the moon or other airless celestial bodies, the De Laval nozzle will be required. For most applications a slot nozzle may be used.

A further alternate embodiment replaces the solar heating means by electrical heating means.

It is obvious to one skilled in the art that sheet metal plates may be fabricated by the above described apparatus merely by peeling the deposited metal off the form after it has rotated under the metal vapor deposited beam. Similarly an endless belt could be employed for form 12 with the same principle of peeling the fabricated metal off the moving belt.

Figure 7:
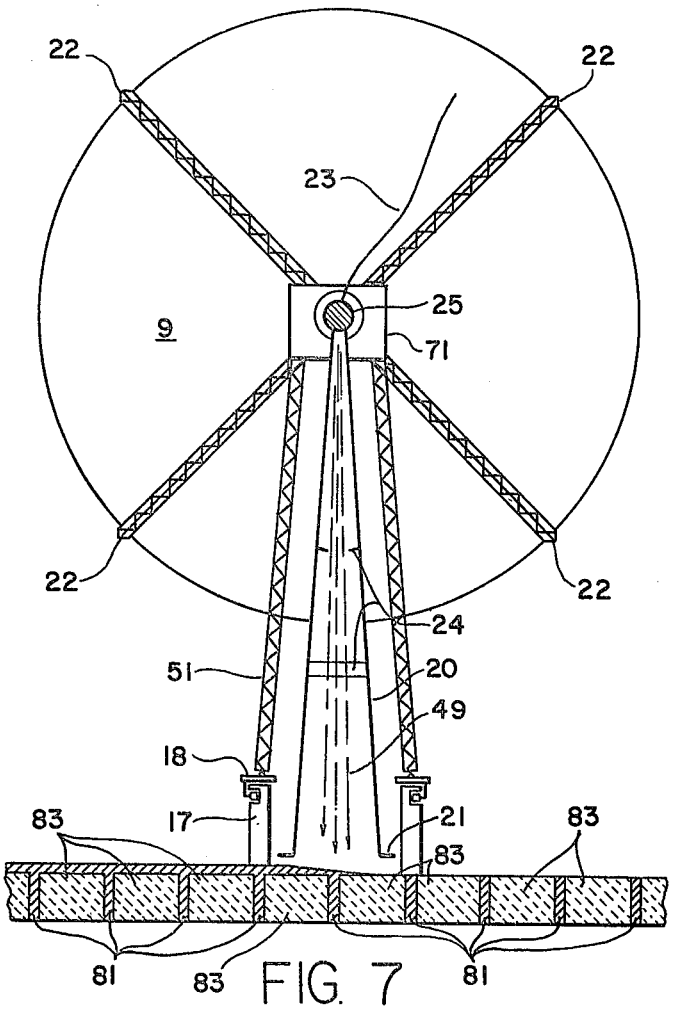
FIG. 7 illustrates a device for manufacture of structural beams and columns.

For the manufacture of complex shapes by the indicate device, reference is made to FIG. 7 where with the use of metal substrate strips, structural beams and columns of vaporized metal deposition can be constructed. For example, in FIG. 7, a beam or column in the process of construction is shown wherein the metal vapor is being deposited upon and joined to a plurality of parallel metal substrate strips 81, of which the end is shown, the metal strips being interlaced by elongated spacing material strips 83, which may be a metal dissimilar to metal strips 81, or a substance which does not adhere to the deposited metal vapor. For example, if metal strips 81 are elongated aluminum strips, and the metal vapor also aluminum, elongated strips 83 may be lead, or a refractory material such as a ceramic. If lead is utilized for spacing material 83, it could be easily removed from between elongated strips 81 by stripping, or for that matter, by melting it out. Use of a ceramic material for elongated strips 83 by removed by stripping. Both elongated strips reside upon a platform which is movable in two directions, the directions both being perpendicular to the direction of the vapor beam. In this way, the column is plated side to side, and then lengthwise until the desired demensions are obtained.

Figure 8:
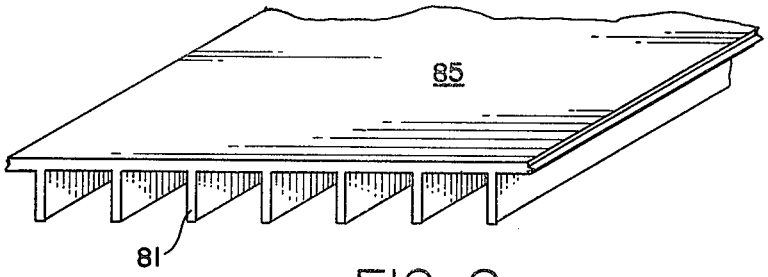
FIG. 8 is a perspective view of a completed structural column.

Referring now to FIG. 8, a perspective view of a completed column is shown where the flat plated surface 85 formed by the deposition of the metal vapor is metallurgically joined to one side of the metal strips 81 to form the completed column. The material 83 interposed for plating reasons between metal strips 81 has been previously removed.

An additional way of preparing the elongated strips 81 and 83 for impingement by the metal vapor would be to cast the removable material 83 around the elongated strip 81, and then grinding or machining a surface to expose the elongated strip 81 which, as indicated earlier, is metallurgically joined to the metal vapor by deposition.

The top surface of the combined arrangement of elongated strips 81 and 83, and especially strips 81, if not formed in a vacuum, must be cleansed of oxides and other contaminates prior to exposure to the metal vapor. If a part of the metal vapor is ionized, a simple cleaning method is to bias the metal strips 81 to several thousand volts negative. The impingement ions will then sputter off oxides and other surface contaminates and thereby accomplish the task.

Figure 3:
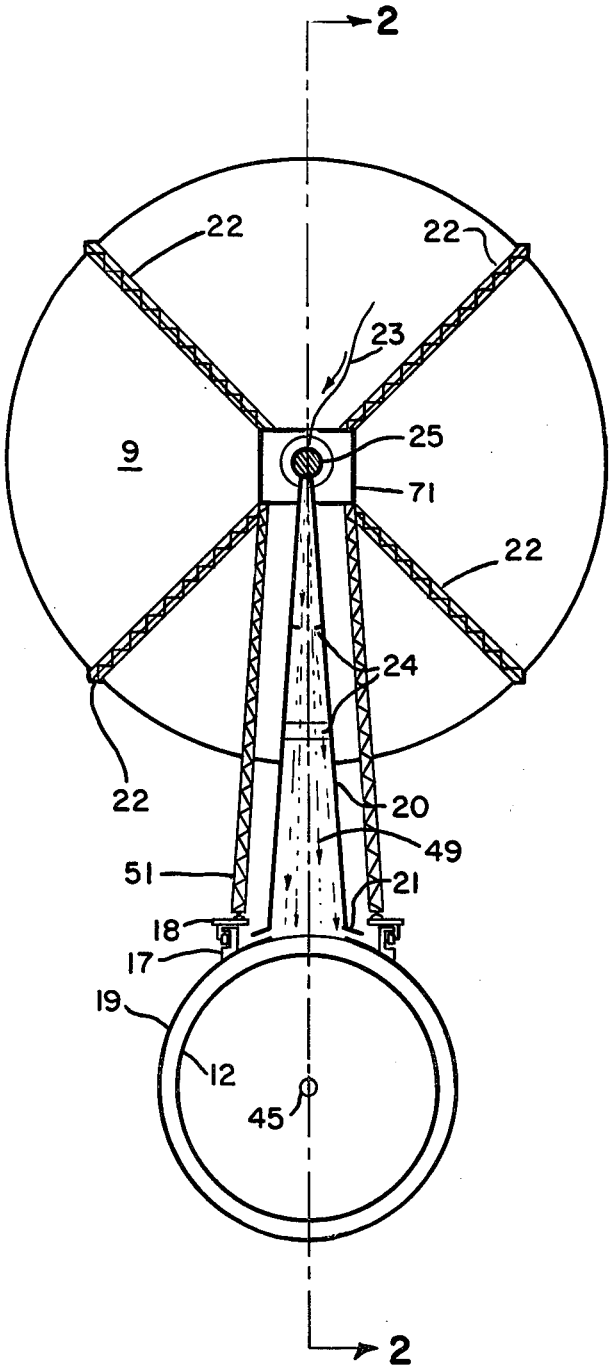
FIG. 3 is an end view of the subject invention taken at the cross-sectional lines 3—3.
Figure 9:
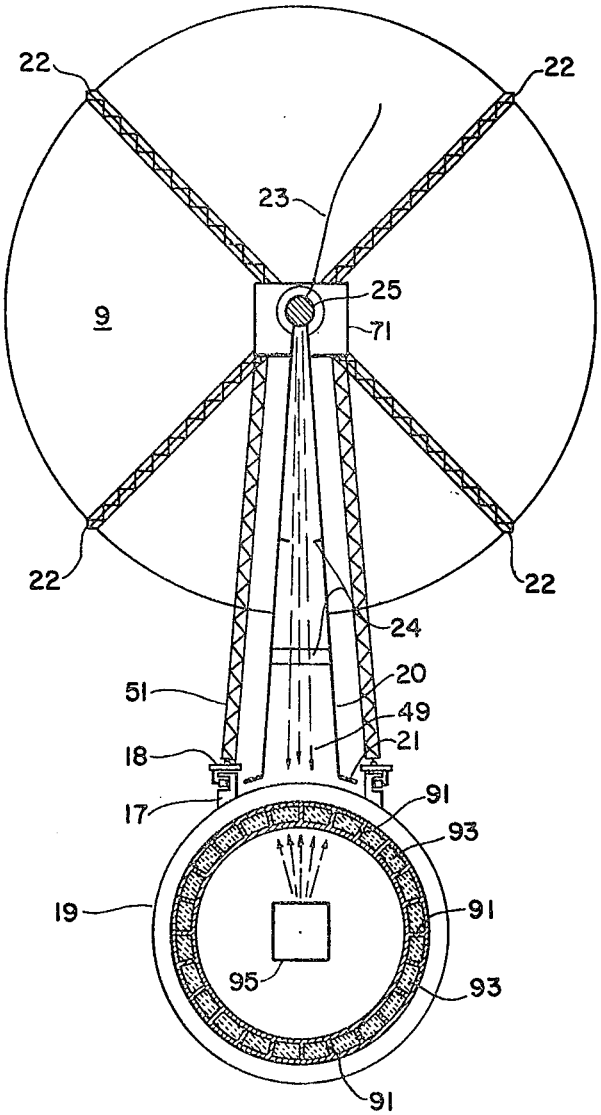
FIG. 9 is a device for forming cylindrical shapes.

For the manufacture of other complex shapes, and referring now to FIG. 9, the device may be used to form cylindrical shapes, such as which might be employed as the sides in a pressure vessel wherein similar manufacturing techniques as detailed above for a column are utilized. Here, form 12 shown in FIG. 3 has been replaced by a series of elongated metal substrate strips 91 alternately spaced between spacing strips 93 which will ultimately be removed by melting or perhaps vaporization. Now in the forming technique as shown in FIG. 9, a surface is plated upon the tops of strips 91 and strip 93 to form an outside coating which, upon the complete rotation of the series of alternate strips 91 and 93, form a completed outer vessel wall. Then, an interior vapor source 95, which may be conventional design, or a modified source such as the invention of this application, is used to plate the inner surface and metallurgically connect with and attach to elongated metal substrate strips 91, and plate over the elongated strips 93.

By the means which have been described to form the complex shapes, it is obvious that objects such as aircraft wings could be formed by rotation within a metal vapor stream in a controlled way, thickness of the deposited metal vapor being controlled by the time the surface is perpendicular to the metal vapor stream and thus leading to the desired thickness of metal being deposited. Under temperature controlled conditions, metal of essentially ordinary bulk characteristics would form the surface, connected to a complex structure within the substrate. The adhesion of the deposited layer to the similar material of the metal strips, providing clean surfaces are exposed, is the same as the bulk material properties of the metal.

The vapor source 95 indicated in FIG. 9 may be of the type widely available, a typical one being AIRCO Model SRIH-270-1. Use of this vapor source is facilitated by removal of air from the interior of chamber 19 with the combined metal strips 91 and 93 heated by electrical heater strips in close proximity thereto (not shown) until a proper deposition temperature is indicated. Then with the combined metal strips 91 and 93 biased to a proper negative voltage, such as 10,000 volts, the vapor source then might be initiated to start depositing its stream of metal vapor upon the interior portion of the strips 91 and 93.

After several minutes, the electrical bias voltage is removed from the alternate combined strips 91 and 93, since by that time the necessary substrate, i.e., strip 91, has been properly cleaned and the vapor source now allowed to proceed to deposit its layer of metal, which, if strips 91 were aluminum, would also be aluminum. If strips 91 were aluminum as well as the metal vapor, then a suitable alternate strip 93 may be lead. After the plating operation has been completed, the lead strips 93 may be melted out by heating of the resultant shape leaving an elongated cylinder having considerable strength when placed in both tension or compression.

While the preferred embodiment together with alternate embodiments of the invention have been shown and described, it would be understood that there is no intent to limit the invention by such disclosure but rather it is intended to cover all modifications and alternate construction falling within the spirit and scope of the invention as defined in the appended claims.

We claim;

1. A method for forming a complex object from a plurality of substrates having a layer of vaporized materials depositing thereon interconnecting the substrates comprising the steps a. surrounding the plurality of substrates with a second material;

b. removing of a portion of the second material away from the plurality of substrates to expose a part of each of the substrates;

c. heating the materials to vaporize;

d. depositing the vaporized materials upon the exposed portion of each of the substrates and upon a part of the second material;

e. removing the second material; and f. exposing the complex object formed of the vaporized material and plurality of substrates.

2. The method for forming a complex object as defined in claim 1 wherein the step of surrounding the substrates with a second material comprises the step of casting the second material around the substrates; and the step of removing a portion of the second material away from the substrates comprises the step of machining a portion of the second material away from the substrates.

3. The method for forming a complex object upon the substrates as defined in claim 1 wherein the step of removing the second material comprises the step of heating and melting the second material to remove the second material.

4. The method for forming a complex object upon the substrates as defined in claim 1 wherein the steps of surrounding the substrates with a second material and removing a portion of the second material away from the substrates to expose a part of the substrates comprises the step of placing the second material in close proximity the substrates so as to expose only a portion of the substrates.

5. The method for forming a complex object upon the substrates as defined in claim 4 wherein the step of placing the second material in close proximity the substrates comprises the step of interweaving the substrates and second material in an alternate fashion to expose alternately spaced portions of the substrates.

* * * * *